US006032874A

United States Patent [19]

Vestergaard

[11] Patent Number: 6,032,874

[45] Date of Patent: Mar. 7, 2000

[54] MIXING APPARATUS FOR SPRAYING A LIQUID MIXTURE

[76] Inventor: Martin Vestergaard, Søhøjen 15, Svogerslev, DK-4000 Roskilde, Denmark

[21] Appl. No.: 09/072,180

[22] Filed: May 5, 1998

[30] Foreign Application Priority Data

May 5, 1997 [DK] Denmark ..... 0511/97

[51] Int. Cl.[7] ..... B05B 7/00

[52] U.S. Cl. ..... 239/61; 239/76

[58] Field of Search ..... 239/61, 62, 76; 417/428

[56] References Cited

U.S. PATENT DOCUMENTS

| | | | |
|---|---|---|---|
| 3,980,230 | 9/1976 | Pringle et al. | 239/61 |
| 4,651,927 | 3/1987 | Vestergaard | 239/61 |
| 5,810,254 | 9/1998 | Kropfield | 239/61 |

FOREIGN PATENT DOCUMENTS 164262 6/1992 Denmark .

*Primary Examiner*—Lesley D. Morris
*Assistant Examiner*—Sean P. O'Hanlon
*Attorney, Agent, or Firm*—Larson & Taylor

[57] ABSTRACT

A mixing apparatus for spraying-out of a liquid mixture of at least two liquids, each from a respective reservoir includes a number of liquid pumps corresponding to the number of liquids. The liquid pumps deliver into a common spraying-out conduit and are each driven by a respective hydraulic motor. The mixing apparatus includes a drive assembly directly operationally connected to a first hydraulic pump controlled in a pressure-regulating manner in dependence on the liquid flow at the outflow side of the apparatus. The first hydraulic pump is associated with a first motor operationally connected to both a first liquid pump and with a mechanical gear. The mechanical gear is directly operationally connected to at least one second hydraulic pump driving at least one second hydraulic motor for at least one second liquid pump having a variable working capacity and hence being controllable.

6 Claims, 3 Drawing Sheets

MIXING APPARATUS FOR SPRAYING A LIQUID MIXTURE

TECHNICAL FIELD

The present invention relates to a mixing apparatus for spraying-out a liquid mixture of at least two liquids in a precise mixing ratio.

BACKGROUND ART

Mixing apparatus of this kind are especially suitable for use when de-icing aircraft. It is necessary to be able to carry out the de-icing work in the course of a very short time and with an accurately set mixing ratio of the liquid. Since the liquids used for de-icing are very sensitive to mechanical influcence possibly causing a degradation, it is also desirable in the liquid-media system to avoid pump systems and valve systems likely to contribute to the degradation.

A previously known mixing apparatus, constructed with a view to solve these problems, comprises hydraulic motors connected in series with a common hydraulic pressure pump and each having a volume per revolution that can be varied from a maximum to a minimum and vice versa, said motors for purposes of adjustment being simultaneously controlled inversely proportionally by a control signal, cf. DK patent No. 164,262.

DISCLOSURE OF THE INVENTION

It is the object of the present invention to provide a mixing apparatus of the kind referred to initially, that is capable of operating with an increased internal precision, and at the same time has potential for an extensive use of uniform operating assemblies.

According to the present invention, a mixing apparatus for spraying-out of a liquid mixture of at least two liquids, each from a respective reservoir includes a number of liquid pumps corresponding to the number of liquids. The liquid pumps deliver into a common spraying-out conduit and are each driven by a respective hydraulic motor. The mixing apparatus includes a drive assembly directly operationally connected to a first hydraulic pump controlled in a pressure-regulating manner in dependence on the liquid flow at the outflow side of the apparatus. The first hydraulic pump is associated with a first motor operationally connected to both a first liquid pump and with a mechanical gear. The mechanical gear is directly operationally connected to at least one second hydraulic pump driving at least one second hydraulic motor for at least one second liquid pump having a variable working capacity and hence being controllable.

As will appear therefrom, the provision of the mutual co-operation of the liquid pumps is allocated to a mechanical gear arrangement, the input end of which is directly drivingly connected to a hydraulic pump driving the motor for a second liquid pump, the operational capacity of said hydraulic pump being variable, so that it can be controlled for regulating and controlling the operational capacity of this second liquid pump with a view to achieving and maintaining a desired mixing ratio in the liquid mixture being sprayed out. According to the invention, the variable control is provided by the use of an electronic signal control unit connected for receiving impulses to the spraying-out conduit for liquid mixture in the mixing apparatus.

The arrangement according to the invention also provides the advantage that it is possible to avoid unintentional spraying-out of solely one of the liquids in the mixture. By letting the liquid pump, the motor of which is also drivingly connected to the gear arrangement, pump a de-icing medium, e.g. glycol, and letting the second liquid pump driven via the variable hydraulic pump, pump e.g. water, it is possible to ensure that when water is being pumped, at least glycol is also being pumped, because the motor working directly for the de-icing medium must necessarily run before it is possible to deliver driving fluid via the variable hydraulic pump to the motor pumping water. This prevents an erroneous situation to arise, in which solely water is being sprayed out.

By constructing the mixing apparatus in the manner set forth in claim 2, it is possible to achieve a particularly quick and accurate adjustment and regulation of the total operation of the mixing apparatus. This embodiment makes it possible to use e.g. a variable electro-hydraulic axial-piston pump giving feedback signals from the pump's variable working members.

Claim 3 relates to a special embodiment for providing pressure-compensated operating conditions at the input end of the mixing apparatus.

As will likewise appear from the above, the variable hydraulic pump constitutes the sole variably operating assembly in the mixing apparatus. The remaining motors and pumps in the apparatus are non-variable and hence simple and easy to service.

The mixing apparatus according to the invention is not restricted to mixing solely two liquids. It will be possible to connect more than one variable hydraulic pump with associated pumps, motors and liquid pumps to the gear arrangement. Further, the mixing capacity of the mixing apparatus is not predetermined to lie within fixed limits, but is variable, all according to the choice of the sizes of motors, pumps and gear ratio.

BRIEF DESCRIPTION OF THE DRAWINGS

In the following detailed part of the present description, the invention will be explained in more detail with reference to the diagrammatic drawing, in which.

DESCRIPTION OF THE PREFERRED EMBODIMENTS

Figure 1:
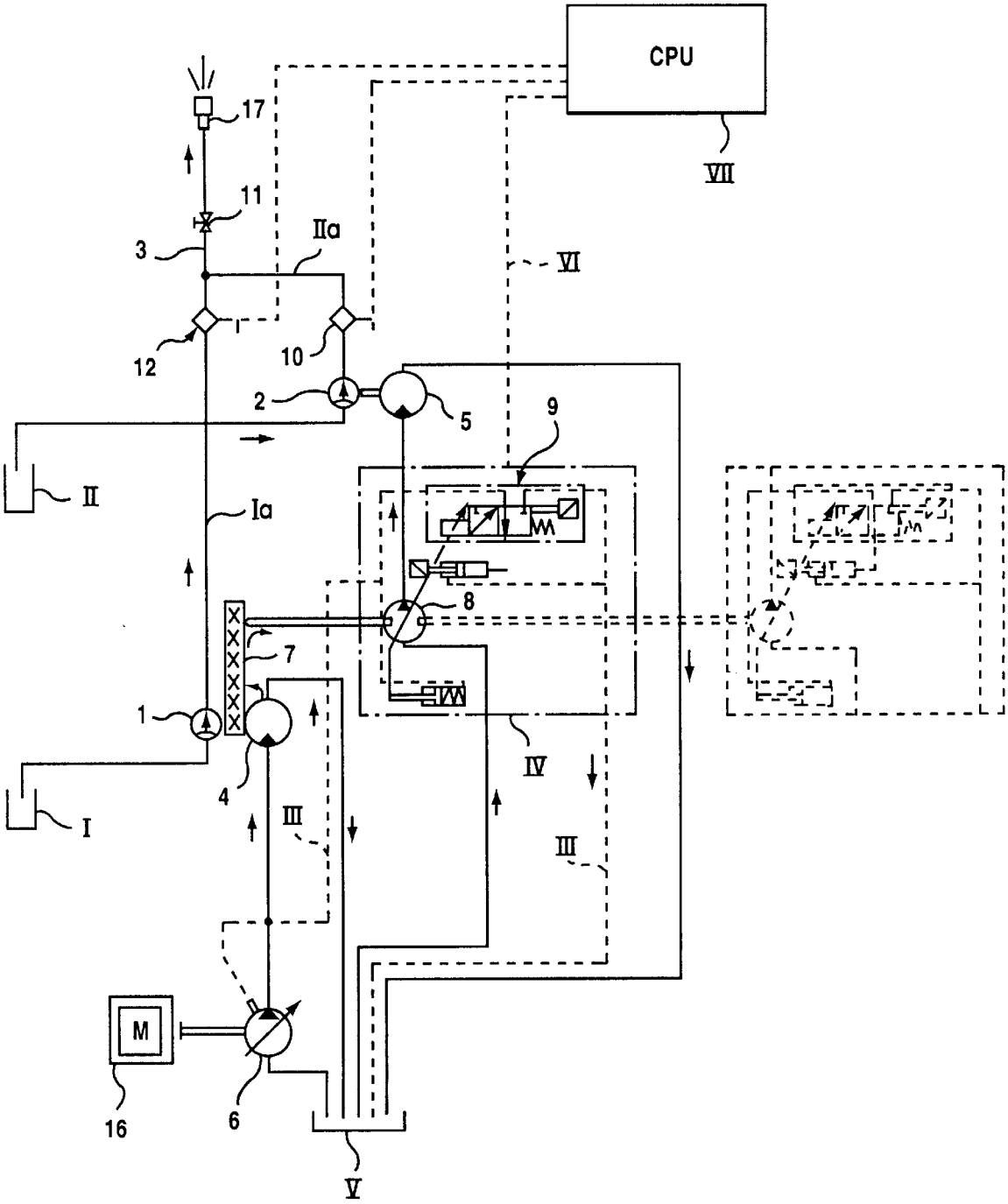
FIG. 1 shows the construction of a first exemplary embodiment of the mixing apparatus.

The embodiment of the mixing apparatus shown is based upon mixing together and jointly spraying-out of two liquids, each being kept in a separate reservoir I and II, respectively. As an example, liquid I can be glycol and liquid II be water.

Each reservoir is associated with a pump 1, 2, respectively, each pumping the liquid concerned into a common spraying-out conduit 3. In this conduit 3, the liquids I and II are intermixed, and the mixture is sprayed out through a spraying nozzle 17. The pumps being used are displacement pumps with a predetermined displacement for each revolution.

Each of the pumps 1 and 2 is driven by a hydraulic motor 4, 5, respectively. Both motors have a predetermined displacement per revolution.

The motor 4 of the pump 1 is associated with a hydraulic pump 6, which is directly mechanically coupled to a drive assembly 16 constituting the driving power source for the entire mixing apparatus.

The motor 5 of the pump 2 is associated with a hydraulic pump 8 of the kind having a variable displacement per revolution and hence being controllable.

The variable hydraulic pump 8 coupled to a mechanical gearbox 7 in a motion-transmitting manner by means of a direct mechanical connection. The gearbox 7 is directly connected to the motor 4 and the pump 1.

The interconnecting conduits between the reservoirs I and II and the spraying nozzle 17 are designated la and Ila, respectively. They merge into the common intermixing spraying-out conduit 3 carrying the spraying nozzle 17. The conduit 3 comprises a stopcock 11 for spraying-out or blocking the liquid mixture formed in the conduit.

The hydraulic pump 6 and the associated hydraulic motor 4 are adapted to cooperate in a pressure-compensating manner in order to maintain a constant pressure in the motor 4. When the stopcock 11 is opened with a view to spraying-out the liquid mixture I plus 11, the pressure in the spraying conduit 3 will fall. As a consequence of this, a smaller turning moment is required to drive the pumps 1 and 2. This will again enable the hydraulic motor 4 to drive the mechanical gearbox 7, because a constant pressure in the motor 4 is maintained due to the pressure compensation. This means that when the stopcock 11 is opened or closed, respectively, a regulation of the flow through the entire system of the mixing apparatus will be achieved, both for the liquid mixture and for the hydraulic drive system.

By means of the gearbox 7 and the variable hydraulic pump 8 it is possible to vary the number of revolutions of the pump 2, so that it is possible to run the pump 2 from zero revolutions for each revolution in the pump 1 right up to a maximum number of revolutions for each revolution in the pump 1. On this basis, it will be possible to compute the proportion of the total liquid mixture of the liquid 11 that can be supplied from the pump 2, and to use the result of the computation as a quickly accessible and very accurate basis for a regulation of the supply of hydraulic liquid from the variable hydraulic pump 8 to the motor 5 of the pump 2.

The amount of liquid being delivered from the pump 2 can be adjusted and regulated by using a variable pump 8, e.g. comprising a control means in the form of a disk-like control member (not shown), the angular position of which determines the displacement per revolution of the pump. In the exemplary embodiment, a proportional valve 9 is used for regulating purposes, this valve being integrated in a circuit III for hydraulic control of the liquid leaving the pump 6, and after having passed through a control assembly, as a whole designated IV, this liquid again ends up in a reservoir V for the working liquid of the hydraulic system. The reservoir V also supplies the driving units for the pumps I and II, i.e. the unit 4 plus 6 and the unit 4 plus 8 plus 5, respectively. The proportional valve 9 is connected to an electronic signal controller VII via a conduit VI, said controller being adapted to adjust and regulate said disk-like control member, hence controlling the supply of hydraulic liquid to the motor 5.

After setting a programmed mixing ratio between the mixing liquids, taking place using the electronic signal controller VII, the controller is constantly being kept informed about the instantaneous composition of the mixture by means of flowmeters 10 and 12, respectively, inserted in the connecting conduits II*a* and I*a*, respectively. In the signal controller VII, the electronic signals emitted from it are compared to the desired mixing ratio as set in the controller.

A divergence between the desired mixing ratio as set and the actual mixing ratio causes an electronic signal to be transmitted from the signal controller VII to the proportional valve 9 for adjusting the e.g. disk-like control member in the variable hydraulic pump 8, so that the supply of hydraulic liquid from this pump 8 to the motor 5, the rotational speed of the pump 2, and in consequence hereof the mixing ratio in the spraying-out conduit 3, will be changed.

EXAMPLE

Based upon the weather conditions, especially the temperature, the operator chooses a mixing ratio between e.g. glycol in reservoir I and water in reservoir II in a ratio of e.g. 25% liquid I and 75% liquid II in the total mixture in the spraying nozzle 17. This means that for each time the pump 1 delivers one liter of glycol, the pump 2 has to deliver three liters of water. If both these two pumps are of the same type, this will mean that operation is to take place with the same mutual ratio between the rotational speeds of the two pumps, considering, however, possible differences between the viscosities of the two liquids as a consequence of varying temperature conditions. In order to achieve the mixing ratio mentioned, the variable hydraulic pump 8 is to be so adjusted that the values sensed by the flowmeters 10 and 12 have a mutual ratio of one to three.

When the stopcock 11 is opened for spraying out the liquid mixture through the nozzle 17, the pressure in the spraying conduit 3 will fall. As a consequence of this, a reduced turning moment is required to drive the pumps 1 and 2. Since the hydraulic motor 4 as explained above operates in a pressure-compensated manner and hence maintains a constant pressure in the hydraulic motor 4, the latter will now supply a driving force to the gearbox 7 and hence to the variable hydraulic pump 8 to provide the desired adjustment of the mixing ratios. In this manner, the adjustment becomes self-regulating.

The embodiment of the mixing apparatus according to the invention as described to this point is based upon a pressure-compensated operation of the hydraulic pump 6 driving the system.

Figure 2:
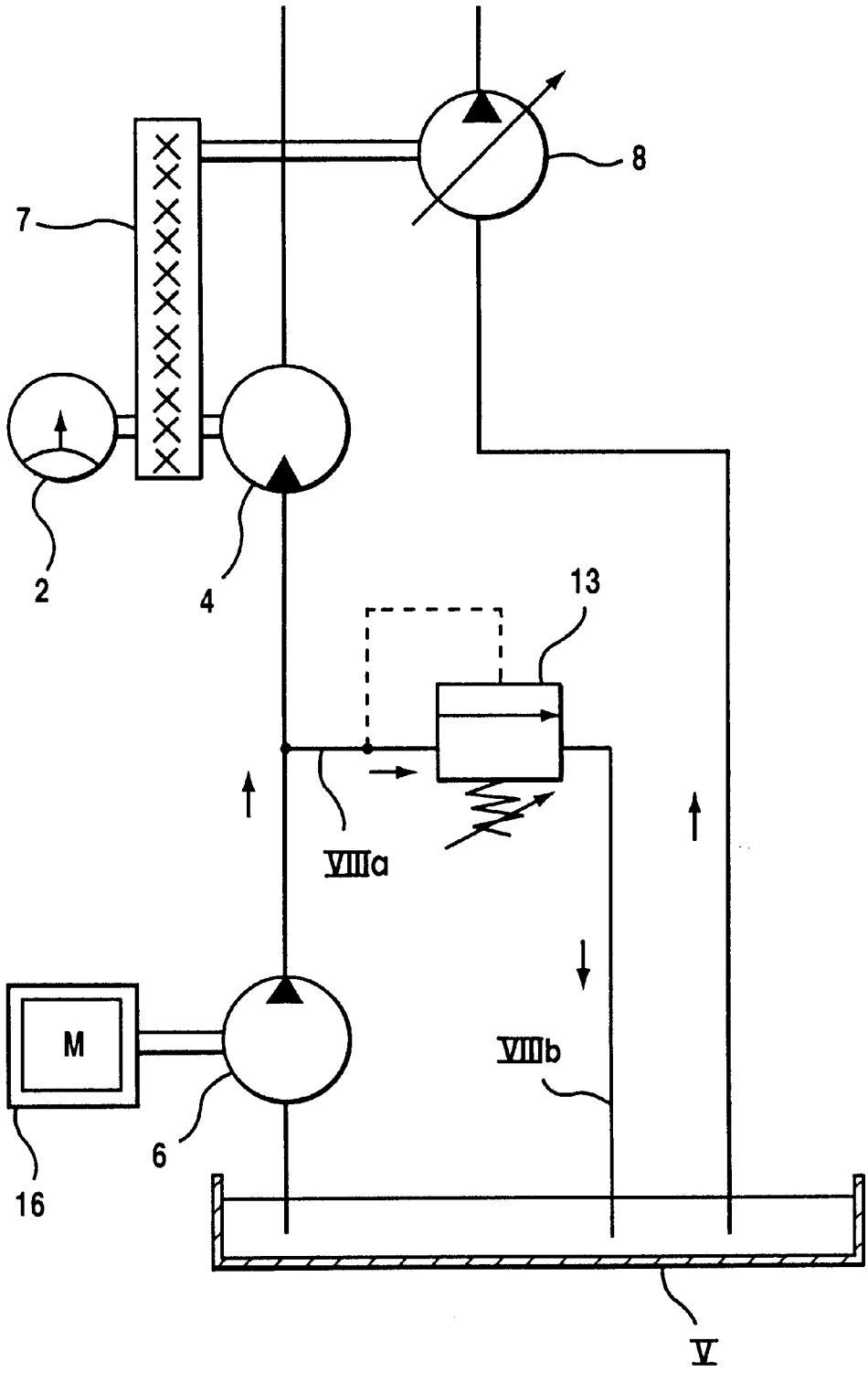
FIG. 2 shows a second exemplary embodiment of a system for regulating a hydraulic working-medium system.
Figure 3:
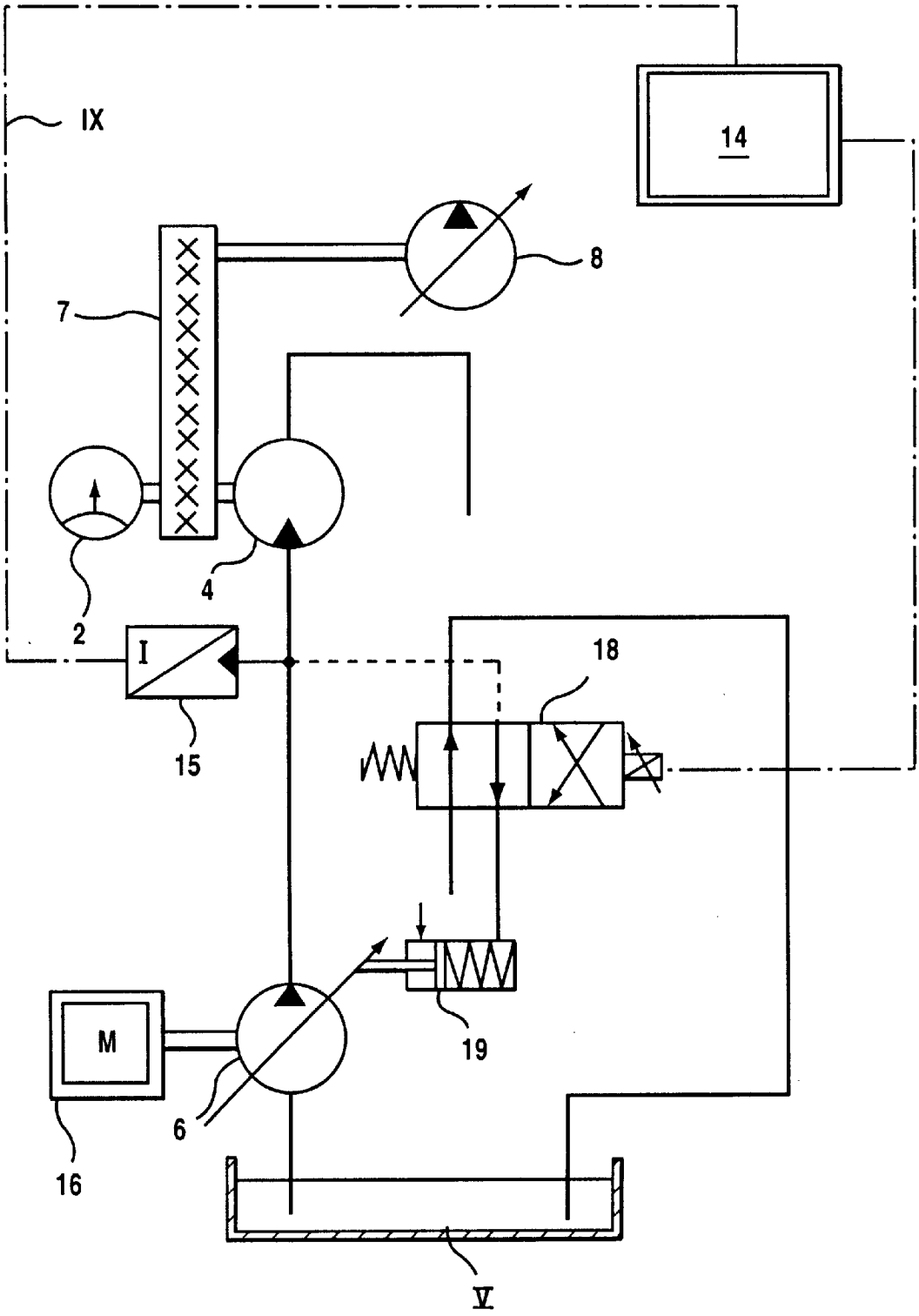
FIG. 3 shows a third exemplary embodiment of such a system.

Two other exemplary embodiments for achieving a controlled supply of hydraulic liquid to the motor 4 are shown diagrammatically in FIGS. 2 and 3.

FIG. 2 shows an embodiment, in which the hydraulic pump 6 is a constant hydraulic pump delivering a constant amount of hydraulic liquid for each revolution of its rotor. The pump is so dimensioned that under all operating conditions it can supply sufficient hydraulic liquid to drive the motor 4 with the desired rotational speed. An excess-pressure valve 13 is connected to the conduit between the hydraulic pump 6 and the motor 4 by means of a branch conduit VIII*a*. The valve 13 is adapted to open if the liquid pressure in the valve exceeds a predetermined limit. If so, surplus hydraulic liquid will flow back to the return conduit VIII*b* to the reservoir V for the operating liquid of the hydraulic system. Thus, a constant pressure is maintained in the motor 4, and a constant turning moment is delivered to the gear box 7.

FIG. 3 shows an embodiment, in which the hydraulic pump is a variable pump, the displacement of which per revolution is electronically controlled by means of a regulator 14 (not shown in detail), a pressure transmitter 15 and a proportional valve 18. The electronic signal conduit is designated IX. The pressure in the connecting conduit between the hydraulic pump 6 and the motor 4 is constantly being measured by the pressure transmitter 15, signalling to the regulator 14. The regulator 14 can determine the movement of the piston in a control cylinder 19 through the proportional valve 18. In this manner, the displacement of liquid per operational revolution in the hydraulic pump 6 is determined. In this manner, it is also possible to maintain a constant operating pressure in the connecting conduit between the hydraulic pump 6 and the motor 4, and hence a constant turning moment driving the gearbox 7.

LIST OF PARTS

| | |
|---|---|
| I | reservoir |
| Ia | connecting conduit |
| II | reservoir |
| IIa | connecting conduit |
| III | circuit |
| IV | control assembly |
| V | reservoir |
| VI | conduit |
| VII | electronic signal controller |
| VIIIa | branch conduit |
| VIIIb | return conduit |
| IX | electronic signal conduit |
| 1 | pump |
| 2 | pump |
| 3 | spraying conduit |
| 4 | hydraulic motor |
| 5 | hydraulic motor |
| 6 | hydraulic pump |
| 7 | gearbox |
| 8 | hydraulic pump |
| 9 | proportional valve |
| 10 | flowmeter |
| 11 | stopcock |
| 12 | flowmeter |
| 13 | excess-pressure valve |
| 14 | regulator |
| 15 | pressure transmitter |
| 16 | drive assembly |
| 17 | spraying nozzle |
| 18 | proportional valve |
| 19 | control cylinder |

I claim:

1. Mixing apparatus for spraying-out of a liquid mixture comprising at least two liquids, at least one of said liquids being sensitive to mechanical wear each of said liquids being from a respective reservoir, the apparatus having at least one liquid pump associated with each of said liquids, said liquid pumps delivering into a common spraying-out conduit, each of said liquid pumps being driven by respective hydraulic motor, the mixing apparatus further comprising a drive assembly directly operationally connected to a first hydraulic pump controlled in a pressure-regulating manner in dependence on liquid flow at an outflow side of the apparatus, the first hydraulic pump being associated with a first hydraulic motor, the first hydraulic motor being drivingly connected to both a first liquid pump and to a mechanical gear, the mechanical gear being directly drivingly connected to at least one second hydraulic pump driving at least one second hydraulic motor for at least one second liquid pump, said second hydraulic pump having a variable working capacity and being controllable.

2. Mixing apparatus according to claim 1, wherein the second, hydraulic pump is adapted for continuous electronic control of its working volume.

3. Mixing apparatus according to claim 1, wherein the first hydraulic pump and the associated hydraulic system are adapted for pressure-compensated co-operation for maintaining a constant pressure in the first hydraulic motor.

4. Mixing apparatus according to claim 1, wherein the first hydraulic pump comprises a constant-displacement pump, the output side of said constant displacement pump being connected to a pressure-controlling excess-pressure valve.

5. Mixing apparatus according to claim 1, wherein the first hydraulic pump comprises a variable hydraulic pump, the displacement of hydraulic liquid of said variable hydraulic pump being electronically controlled for maintaining a constant operating pressure between said variable hydraulic pump and the first hydraulic motor.

6. Mixing apparatus according to claim 1, wherein flow meters are inserted in supply conduits connecting liquid reservoirs to the spraying-out conduit, said flowmeters being connected to and adapted to transmit signals to an electronic signal controller, connected to and adapted to transmit signals to a control member in the second hydraulic pump.

* * * * *